US008241190B2

(12) United States Patent
Van Straaten

(10) Patent No.: US 8,241,190 B2
(45) Date of Patent: Aug. 14, 2012

(54) EXERCISE MACHINE

(76) Inventor: Willem Johannes Van Straaten, Johannesburg (ZA)

( * ) Notice: Subject to any disclaimer, the term of this patent is extended or adjusted under 35 U.S.C. 154(b) by 0 days.

(21) Appl. No.: 12/836,932

(22) Filed: Jul. 15, 2010

(65) Prior Publication Data

US 2011/0065554 A1 Mar. 17, 2011

(51) Int. Cl.
*A63B 21/04* (2006.01)

(52) U.S. Cl. ..... 482/130; 482/138; 482/142

(58) Field of Classification Search ..... 482/121–126, 482/129–139, 142, 145, 908, 909
See application file for complete search history.

(56) References Cited

U.S. PATENT DOCUMENTS 4,566,691 A * 1/1986 Mahnke ..... 482/104
4,653,751 A * 3/1987 Green ..... 482/104
5,211,617 A * 5/1993 Millen ..... 482/127
5,215,511 A * 6/1993 Cheng ..... 482/121
5,232,426 A * 8/1993 Van Straaten ..... 482/123
5,277,684 A * 1/1994 Harris ..... 482/130
D349,140 S * 7/1994 Rockwell ..... D21/674
5,616,111 A * 4/1997 Randolph ..... 482/133
D380,024 S * 6/1997 Novak et al. ..... D21/690
5,649,886 A * 7/1997 Danylieko ..... 482/142
D384,117 S * 9/1997 Piaget et al. ..... D21/676
5,669,865 A * 9/1997 Gordon ..... 482/142
D389,205 S * 1/1998 van Straaten ..... D21/690
5,718,659 A * 2/1998 Van Straaten ..... 482/130
5,769,767 A 6/1998 Hochberg et al.
5,833,590 A * 11/1998 Chiu et al. ..... 482/142
5,899,836 A * 5/1999 Chen ..... 482/92
6,500,104 B1 12/2002 Rich
6,565,488 B2 * 5/2003 Chen ..... 482/73
6,752,745 B1 * 6/2004 Davis ..... 482/72
6,793,610 B2 * 9/2004 Deola ..... 482/130
7,115,081 B2 * 10/2006 Stearns ..... 482/140
7,226,401 B2 * 6/2007 Van Stratten et al. ..... 482/112
D552,193 S * 10/2007 Husted et al. ..... D21/676
7,468,024 B2 * 12/2008 Webber et al. ..... 482/98
7,575,539 B2 * 8/2009 Kessler ..... 482/138
7,591,763 B1 * 9/2009 Fucci ..... 482/52
7,654,944 B1 * 2/2010 Liu ..... 482/142
7,731,638 B2 * 6/2010 Webber et al. ..... 482/72
7,803,094 B1 * 9/2010 Bolick et al. ..... 482/130
7,806,812 B2 * 10/2010 Humble et al. ..... 482/130
7,811,215 B2 * 10/2010 Wallach ..... 482/130
7,878,953 B2 * 2/2011 Webber et al. ..... 482/95
7,887,470 B2 * 2/2011 Chen ..... 482/138
D647,151 S * 10/2011 Van Straaten ..... D21/676
2002/0123414 A1 * 9/2002 Chen ..... 482/123
2002/0142898 A1 * 10/2002 Willis et al. ..... 482/130
2003/0087737 A1 * 5/2003 Studdard ..... 482/142

(Continued)

OTHER PUBLICATIONS

International Search Report issued Jul. 14, 2011 in International (PCT) Application No. PCT/ZA2010/000035.

*Primary Examiner* — Loan Thanh
*Assistant Examiner* — Daniel F Roland
(74) *Attorney, Agent, or Firm* — Wenderoth, Lind & Ponack, LLP

(57) ABSTRACT

An exercise machine which has a seat and a backrest which are mounted for independent pivotal movement about an axis to respective chosen inclinations, structure which is fixed to, and which is movable together with, the seat, and resistance bands which are located on the structure.

4 Claims, 9 Drawing Sheets

U.S. PATENT DOCUMENTS

2004/0005971 A1* 1/2004 Kuo ..... 482/142
2004/0033868 A1* 2/2004 Van Straaten ..... 482/110
2004/0138032 A1* 7/2004 Van Straaten et al. ..... 482/112
2004/0138033 A1* 7/2004 Van Straaten et al. ..... 482/112
2005/0215400 A1 9/2005 Nerenberg
2006/0122045 A1* 6/2006 Webber ..... 482/142
2007/0117690 A1* 5/2007 Webber ..... 482/94
2007/0129225 A1* 6/2007 Hammer ..... 482/129
2007/0243981 A1* 10/2007 Verheem ..... 482/130
2008/0220950 A1* 9/2008 Webber et al. ..... 482/96
2010/0255965 A1* 10/2010 Chen ..... 482/130
2010/0323861 A1* 12/2010 Karwan ..... 482/145

* cited by examiner

EXERCISE MACHINE

BACKGROUND OF THE INVENTION

This invention relates to an exercise machine.

U.S. Pat. No. 5,718,659 discloses an exercise machine which includes a seat and a backrest mounted to ground-engaging supports, and a resistance mechanism which is pivotally attached to an upper end of the back rest and which is usable by an exerciser on the seat. A negative factor associated with this construction is that when the resistance mechanism is elevated or extends rearwardly of the backrest the structure becomes unstable and can tip over. Also, the spacing between a user and the resistance mechanism is substantial and it can be awkward for the user to exercise properly i.e. to go through a full range of exercise motions.

U.S. Pat. No. 5,232,426 describes an exercise machine which has a seat and a backrest which are pivotally mounted to ground-engaging legs. A resistance device is fixed to, and is extendable at least partly between, lower ends of the legs. This feature can make it difficult for a user to grip handles which are connected to the resistance device due to the position and orientation of the user's body relative to a point through which force is transferred to the resistance device. Ideally the user, while seated in a comfortable position, should be able to align targeted muscles with the resistance force but this is not always possible with some exercises.

The present invention is concerned with an exercise machine which is of compact construction and which offers a range of exercises which can effectively be done by an exerciser without detracting from the safety or stability of the exercise machine.

SUMMARY OF INVENTION

The invention provides an exercise machine which includes a first support member, a second support member which is pivotally movable about an axis relative to the first support member, structure which supports the support members above the ground, first and second arms on respective opposed sides of the first support member, and a resistance device mounted to the first and to the second arms.

The structure may include a hub and the support members may be mounted to the hub. The axis may extend through the hub. The structure may also include first and second ground-engaging legs which extend downwardly from the hub.

In one form of the invention the arms are fixed with respect to the first support member and, when the first support member is pivoted relative to the second support member, the arms are pivoted at the same time.

In a different form of the invention the arms are pivotally movable, in unison, relative to the first support member and the second support member.

The first support member and the second support member may be used as a seat and as a backrest, respectively.

Preferably the seat and backrest are sufficiently similar to each other so that they can be interchanged. In other words the seat can, according to requirement, be used as a backrest for a person using the exercise machine, and the backrest, in turn, can be used as a seat for the person. This interchange depends on the type of exercise being performed.

A single resistance device may be used to provide resistance for exercise purposes. The resistance device may include at least one elastic resistance band.

In a variation of the invention the resistance device includes a first resistance mechanism which is mounted to the first arm and a second resistance mechanism which is mounted to the second arm. Each resistance mechanism may include at least one elastic resistance band.

Preferably each arm includes a cover or shroud or similar enclosure and the respective resistance mechanism is located at least partly therein.

At least one resistance element e.g. an elastic band may be mounted to the first ground-engaging leg. One end of the resistance element may be anchored to a point which is at or near the axis and an opposing end of the at least one resistance element may be fixed to a member which facilitates a user engaging an arm or a leg, say, with the member so that the at least one resistance element can be actuated.

In a preferred form of the invention the exercise machine includes a first support component between the first support member and the first leg which is adjustable thereby to vary the inclination of the first support member relative to the ground, a second support component between the second support member and the second leg which is adjustable thereby to vary the inclination of the second support member relative to the ground, and wherein the first and second support members are pivotally movable to first limiting positions at which the support members oppose each other and the legs are positioned between the support members, and to second limiting positions at which the first support member overlies and is adjacent a first side of the legs and the second support member overlies and is adjacent a second, opposing side of the legs.

BRIEF DESCRIPTION OF THE DRAWINGS

The invention is further described by way of examples with reference to the accompanying drawings in which.

DESCRIPTION OF PREFERRED EMBODIMENTS

Figure 1:
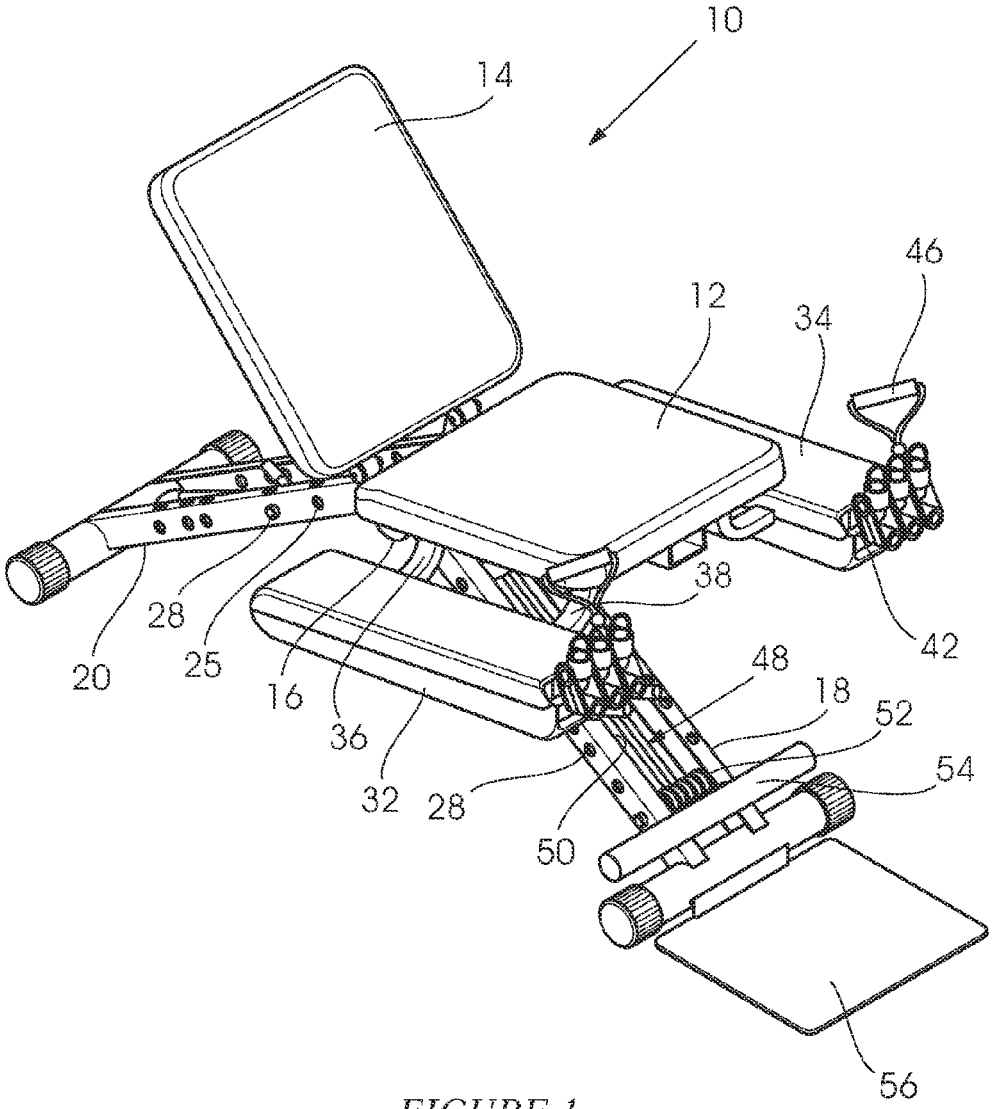
FIG. 1 shows an exercise machine in perspective according to one form of the invention in a first mode.
Figure 2:
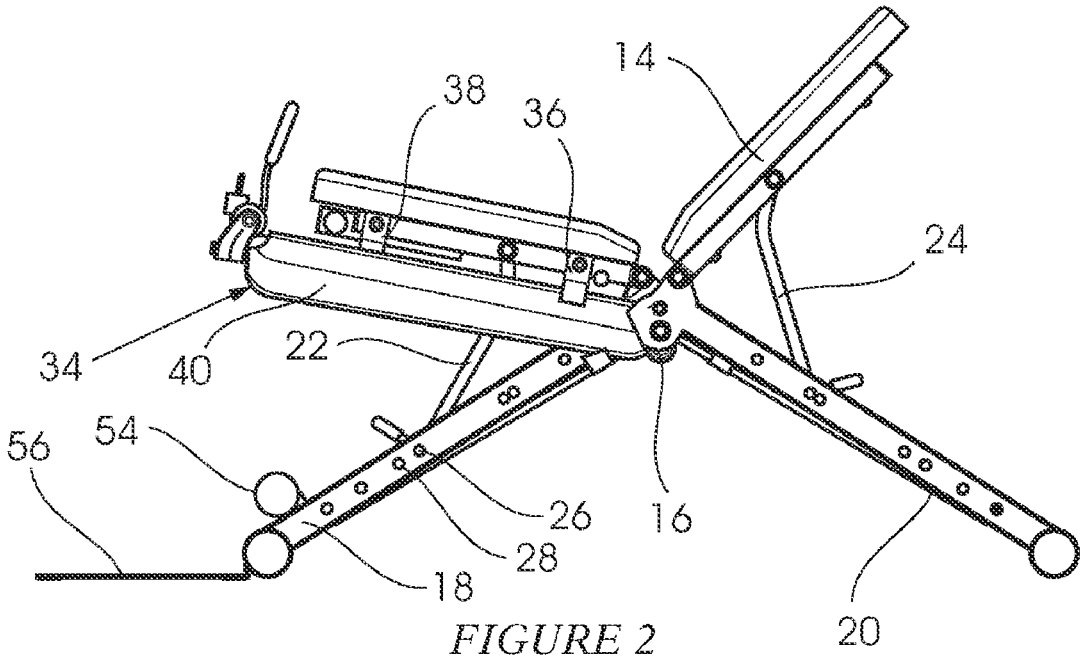
FIG. 2 shows the exercise machine of FIG. 1 from one side.
Figure 3:
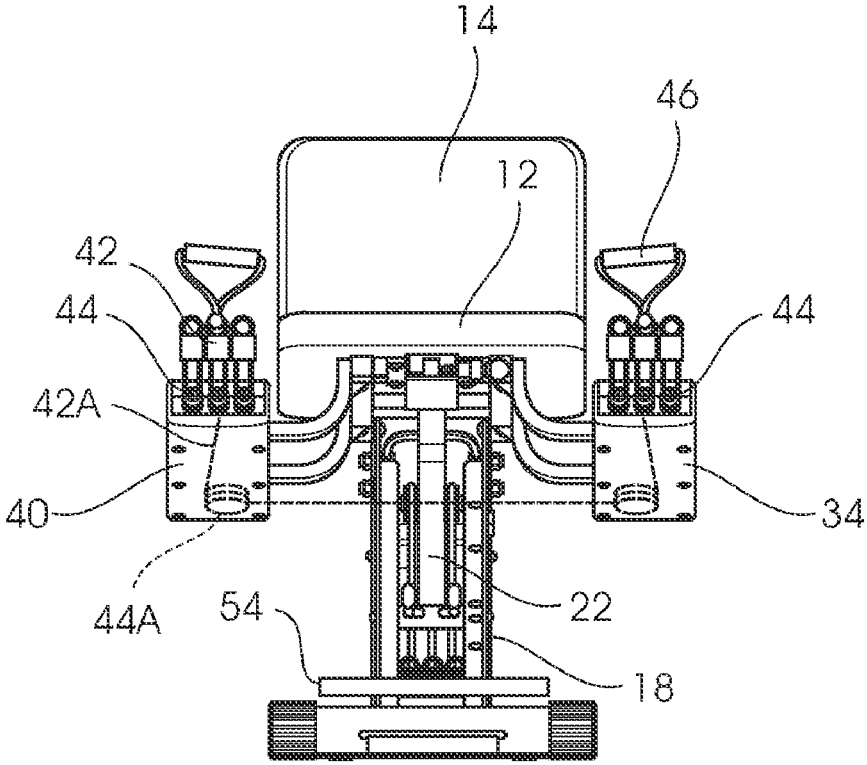
FIG. 3 is a front view of the machine (i.e. from the left in FIG. 2)

FIGS. 1 to 3 illustrate an exercise machine 10 according to a first form of the invention which includes first and second support members 12 and 14 respectively. For practical purposes these support members are identical to each other and thus can be used interchangeably, as required, as a seat and backrest respectively or, conversely, as a backrest and seat respectively.

The support members are mounted for relative pivotal movement about an axis which passes through a hub 16. A first ground-engaging leg 18 is pivotally fixed to the hub 16. A second ground-engaging leg 20 is also pivotally fixed to the hub. A first support component 22 in the form of a strut is positioned between the first support member 12 and the leg 18. A second support component 24, also in the form of an appropriate strut, is positioned between the second support member 14 and the second leg 20. In each instance a spring loaded pin 26 on the respective strut is engageable with a registering pair of holes 28 in the respective ground-engaging leg at a location selected from a number of different positions, so that the orientation of the support member relative to the corresponding ground-engaging leg can be adjusted according to requirement.

First and second arms 32 and 34 respectively are fixed to outwardly-extending support structures 36 and 38 on a rear surface of the support member 12 and project outwardly on respective opposing sides of the support member. The arms are for practical purposes identical to each other and for this reason the construction of one arm only is described. The arm has a shroud 40 which forms an enclosure, for safety and aesthetic purposes, for a plurality of elastic resistance bands 42 which pass over various pulleys 44 inside the shroud at spaced opposed locations. The bands terminate in a handle 46 which is positioned so that it can, with ease, be gripped by a user for exercise purposes.

A resistance element 48 is mounted to the leg 18. The resistance element consists of a number of elastic bands 50 which are anchored, at one end, to a point which is near the hub 16. The bands pass over pulleys 52 which are located near an extremity of the leg 18. The ends of the bands which are near the pulleys are connected to a member 54 which extends transversely and which is shaped to facilitate engagement of a user's feet therewith; alternatively, so that the user can grip the member with the user's hands. Optionally a foot pad 56 is provided at a lower end of the leg 18. The foot pad rests on the ground.

Figure 4:
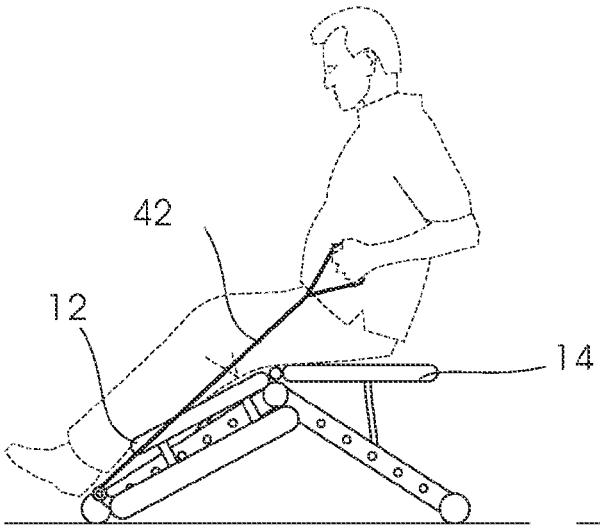
FIGS. 4 to 7 illustrate a range of exercises which can be done by a user of the exercise machine—these exercises are exemplary only and non-limiting.
Figure 5:
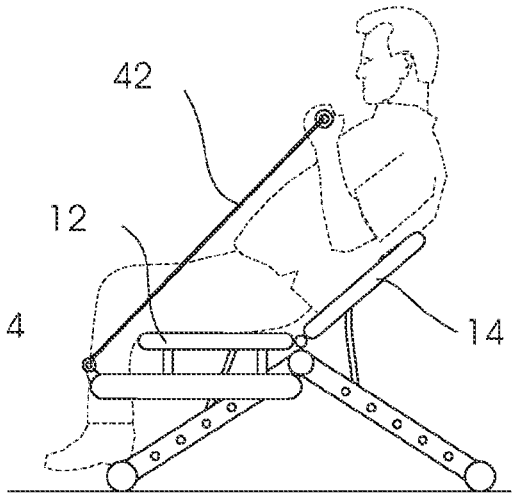

The range of exercises which can be conducted is substantial. FIG. 4 for example illustrates the support member 12 at a lowermost position, acting as a support for lower leg portions of a user. A user is seated on the support member 14. The resistance bands carried by the two arms can be pulled upwardly on outer sides of the user's torso. In the FIG. 5 arrangement the support member 12 is more or less horizontal and acts as a seat while the support member 14 is inclined at an angle of about 45° to the horizontal and acts as a back support. A user can exercise with the resistance bands with a pull-type action.

Figure 6:
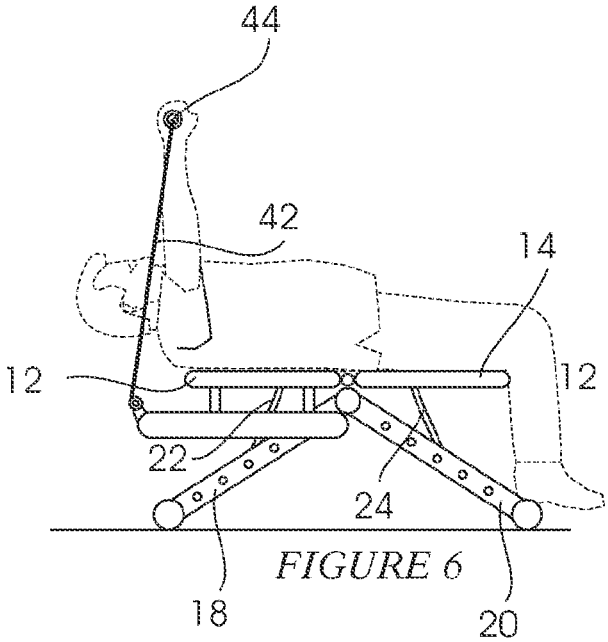

In the FIG. 6 arrangement the support members are more or less horizontal and in line. The user can then do a bench-press-type exercise while reclined on the support members.

Figure 7:
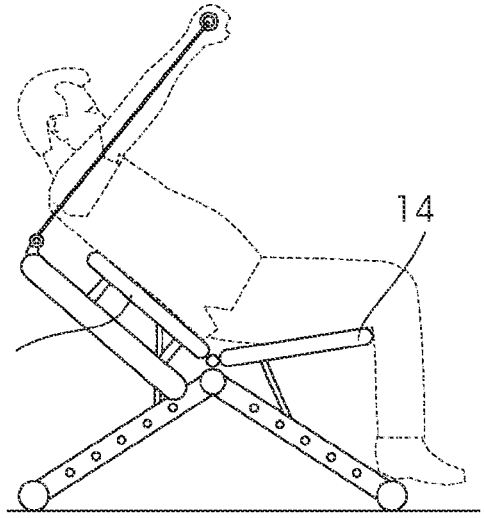

In the FIG. 7 arrangement the support member 14 acts as a seat while the support member 12 acts as an inclined backrest. The arms are thereby positioned so that a user can do a bench-press-type exercise but at a inclined position.

Figure 8:
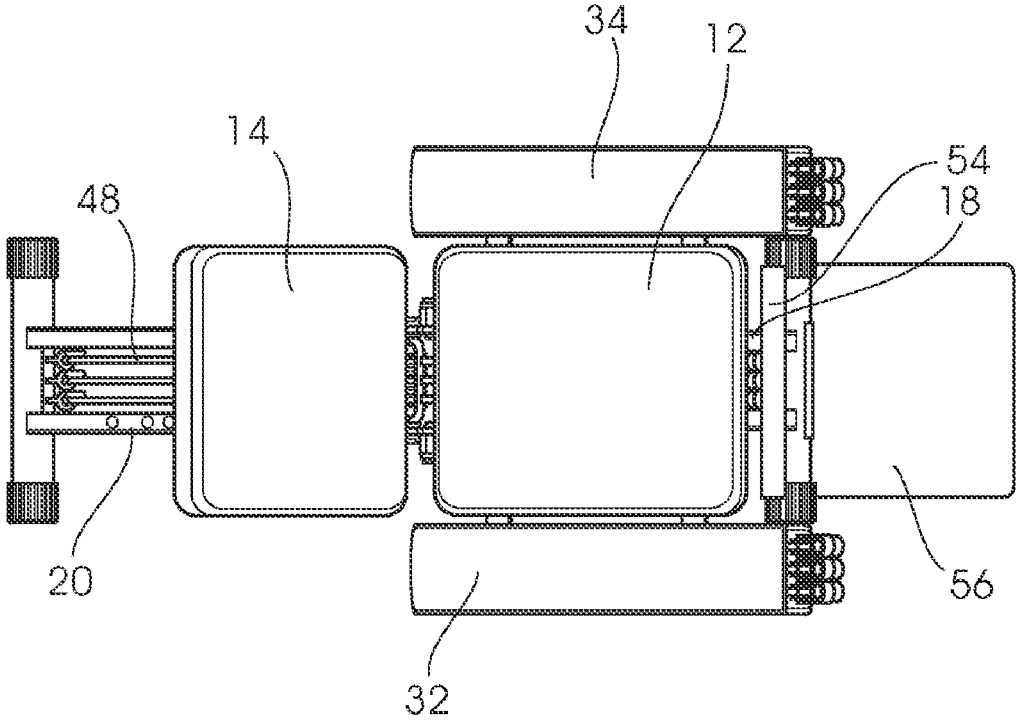
FIG. 8 is a plan view of the exercise machine in FIG. 1.

FIG. 8 shows that the resistance bands 48, which in connection with FIG. 1 are described as extending in the leg 18 between the hub 16 and a lower end of the leg, can be lengthened so that they pass around the hub and then lie partly enclosed by the leg 20. The extremities of the bands are then anchored to a lower end of the leg 20 and not, as previously described, to the hub. The increased band length helps to keep the force which is required to extend the bands, per unit length of extension, more constant.

In the preceding description each arm 32 and 34 has a respective resistance mechanism mounted to it. Although this is a preferred form of construction it is possible for a single resistance device, comprising one or more resistance bands, to be used in place of the two resistance mechanisms. FIG. 3 illustrates a possible construction (in dotted outline) wherein resistance bands 42A are passed around pulleys 44A which are mounted to the arms close to the hub 16 and which are anchored, at opposing ends, to handles 46. With this form of the invention it is required of a user to "balance" the forces which are exerted on the resistance bands 42A during exercise. Alternatively the handles 46 can be alternated to and fro with a reciprocating-type action in different directions due to the linking of the handles by the resistance device.

The member 54 is provided so that leg extension exercises can be conducted by a user. Another possibility is that a user can lie on his back, with the support members 12 and 14 suitably adjusted, and the member 54 can be gripped for a form of overhead arm-curl exercises.

It has been observed that for an exercise to be effective a targeted muscle must be properly aligned with a resistance force. Since a muscle tends to contract along an elongate axis of fibres in the muscle, "alignment" in this respect, means that the direction of resistance must be in direct opposition to the tensile forces which are generated in the fibres of the targeted muscle. In the present invention the seat and the backrest can individually be set to any one of a multiple of possible settings. This means that for a given exercise the user can position the body ergonomically and correctly, and so that the muscles which are targeted for a particular exercise are aligned, as far as is possible, with the forces which are generated by the resistance bands.

Figure 9:
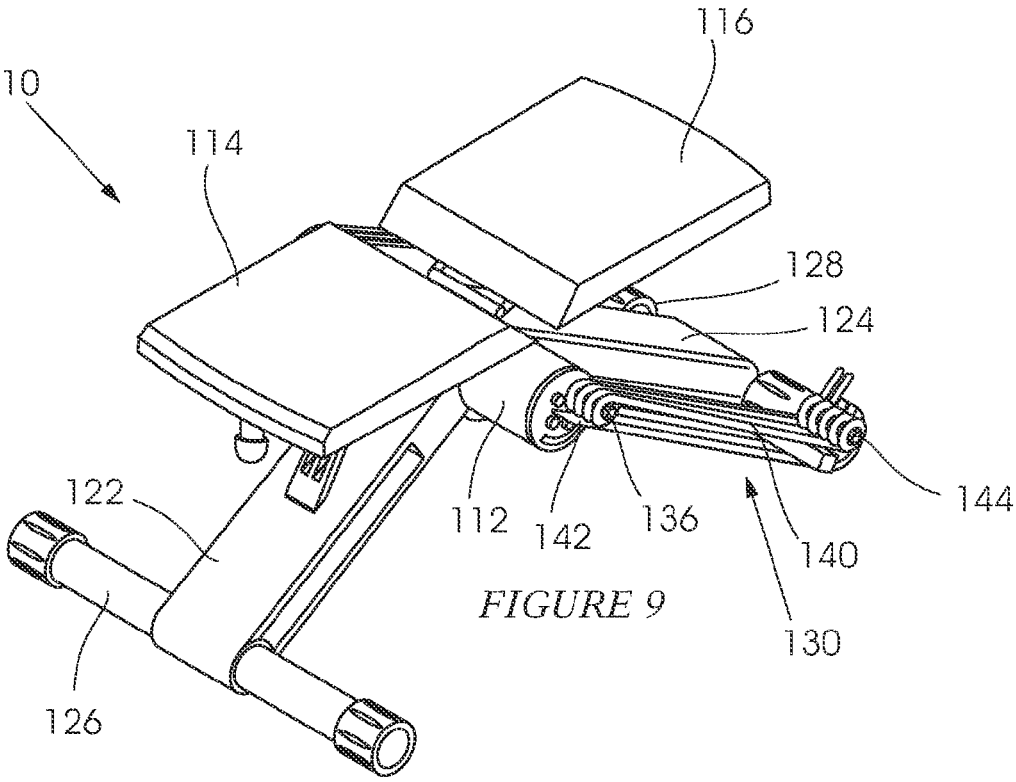
FIG. 9 shows an exercise machine according to a second form of the invention in one mode.

FIG. 9 illustrates an exercise machine 110 according to a second form of the invention in a first mode of use. This machine bears many similarities to the machine shown in FIGS. 1 to 8. A fundamental difference though is that in the first embodiment the arms 32 and 34 are fixed with respect to the first support member 12. In the machine 110 this is not the case for the arms are pivotally movable relative to the first support member and the second support member.

The exercise machine includes a horizontally extending hub 112 with a first support member in the form of a seat 114 and a second support member in the form of a back rest 116 which are mounted to the hub in a manner which allows the seat and back rest to be pivotally moved relatively to the hub independently of each other. The orientation or angle of inclination of the seat, and of the back rest, can be independently altered, within reason, according to requirement, by adjusting the positions of struts 118 and 120 respectively, to chosen inclinations.

First and second legs 122 and 124 are pivotally mounted to the hub. The legs extend downwardly. Each leg has a respective crossbar 126, 128 at a lower end which extends transversely and which is ground-engaging. This type of construction imparts stability to the exercise machine in use.

A resistance mechanism 130 is mounted to the hub. The resistance mechanism includes first and second arms 132 and 134 respectively which are on opposing sides of the seat and back rest. The arms are linked by means of an axle 136 which ensures that the arms are movable in unison, together with the axle 136, with a pivotal action relatively to the hub.

Each arm has attached to it a number of elastic bands 140 which extend around pulleys 142 which are centred more or less on the axle 136, and pulleys 144 at radial outer ends of the arm. Handles, not shown, are attached to ends of the bands close to the pulleys 144. In practice each arm is shrouded by means of a cover not shown, which obscures the bands. This is done for safety and aesthetic purposes.

A small lever 150 is mounted on a rear side of the arm 132. The lever operates on a pin 152 which rides inside a slot 154, in the hub, which has a number of notches (not shown). If the lever is moved in a first direction the pin 152 is disengaged from a respective notch. The arms can then be rotated to a desired position about the axle 136. When the lever is released the pin 152 engages with a notch to ensure that the resistance mechanism is kept at the chosen orientation.

In FIG. 9 the seat and back rest are more or less horizontal and in line. The resistance mechanism extends downwardly and is substantially parallel to the second leg 124.

Figure 10:
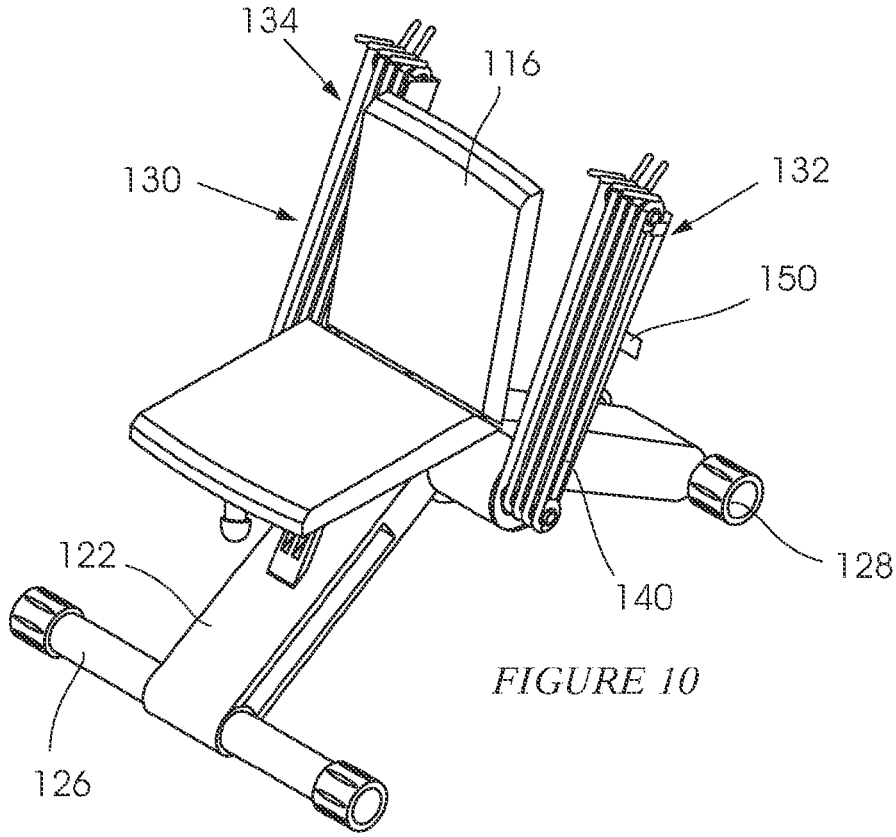
FIG. 10 shows the exercise machine of FIG. 9 in a different mode.
Figure 11:
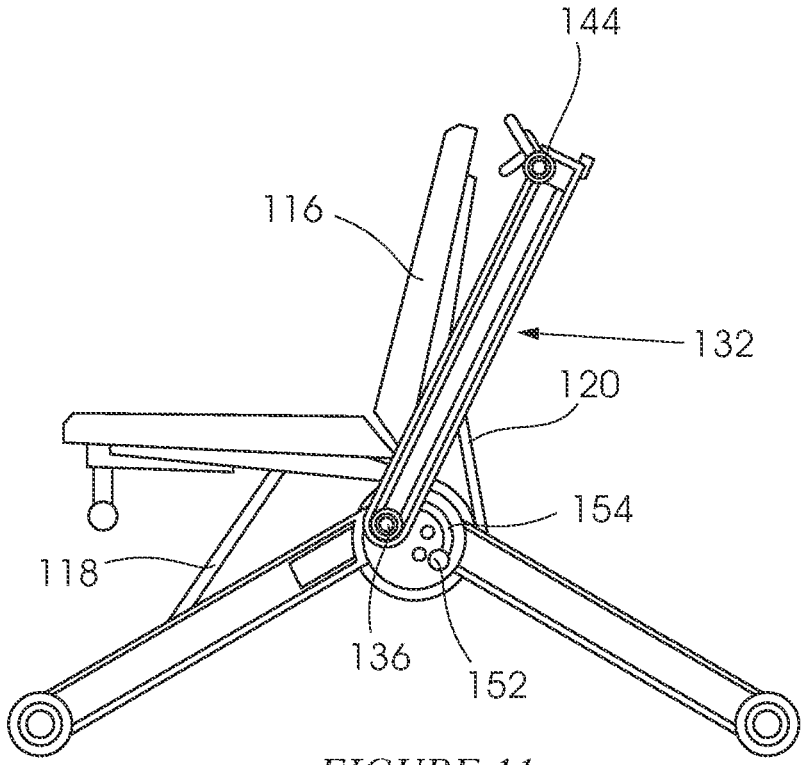
FIG. 11 shows the exercise machine of FIG. 10 from one side.

In the mode shown in FIGS. 10 and 11 the back rest 116 is elevated and the resistance mechanism has also been elevated so that the arms are slightly behind the back rest (in an angular sense).

Figure 12:
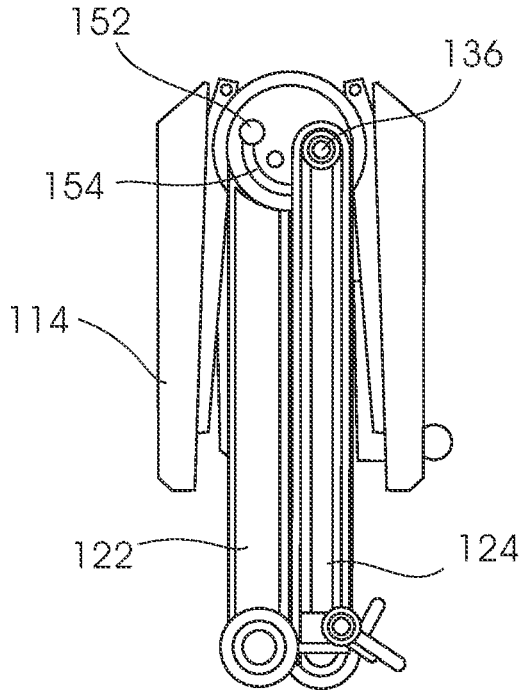
FIG. 12 shows the exercise machine in a compact configuration suitable for storage and transport purposes.

The exercise machine can be folded into a compact configuration, shown in FIG. 12, for storage and transport purposes. In this configuration the legs 122 and 124 are brought substantially together and the seat and back rest are generally parallel to each other on outer sides of the first and second legs. The arms of the resistance mechanism overlie outer sides of the second leg 124.

The capability of the exercise machine to be folded into the compact mode is attributable primarily to the fact that the seat, back rest, the two legs and the resistance mechanism are all pivotal about the hub i.e. more or less about a common axis. (It is noted that the machine 10 can also be folded into a compact form wherein the legs 18 and 20 are between opposing surfaces of the members 12 and 14).

It is evident that, at times, the first support member can form a backrest and, conversely, the second support member can form a seat. Moreover, depending on the exercise which is being performed, either support member could act as a support for the legs or feet of an exerciser.

Figure 13:
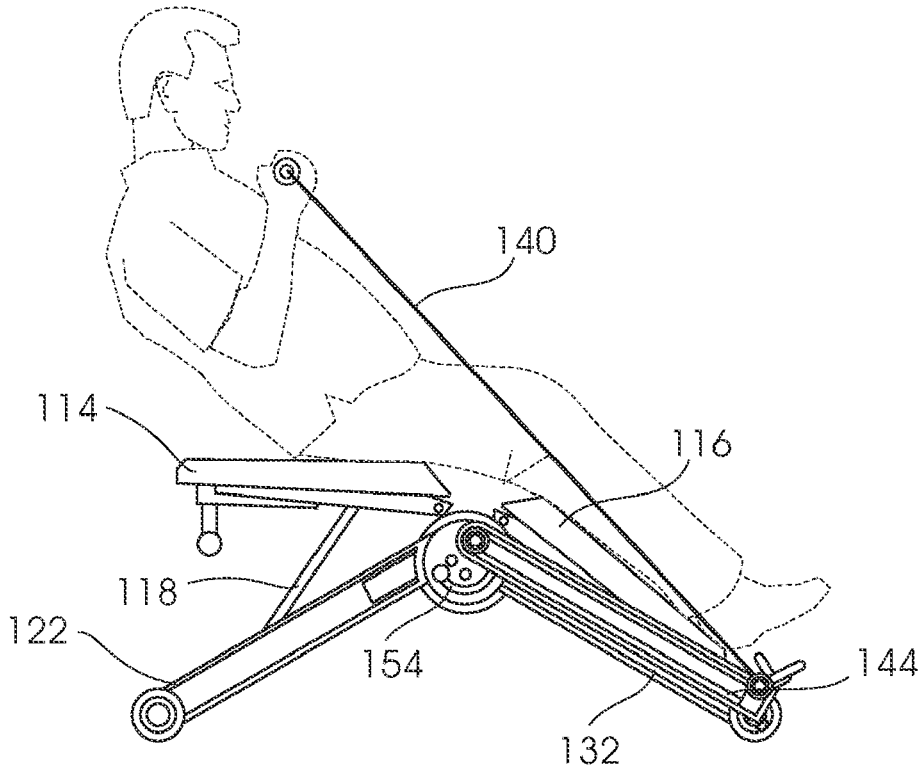
FIGS. 13 to 18 illustrate a range of exercises which can be done in an effective manner by a user of the exercise machine.

The exercise machine lends itself to use in a variety of exercises, shown only by way of example in FIGS. 13 to 18, in an efficient, stable and safe manner. In FIG. 13 the back rest 116 is angled downwardly and the resistance mechanism extends more or less in the same direction parallel to the back rest. A user can then engage in arm pulls on bands 140 of the resistance mechanism.

Figure 14:
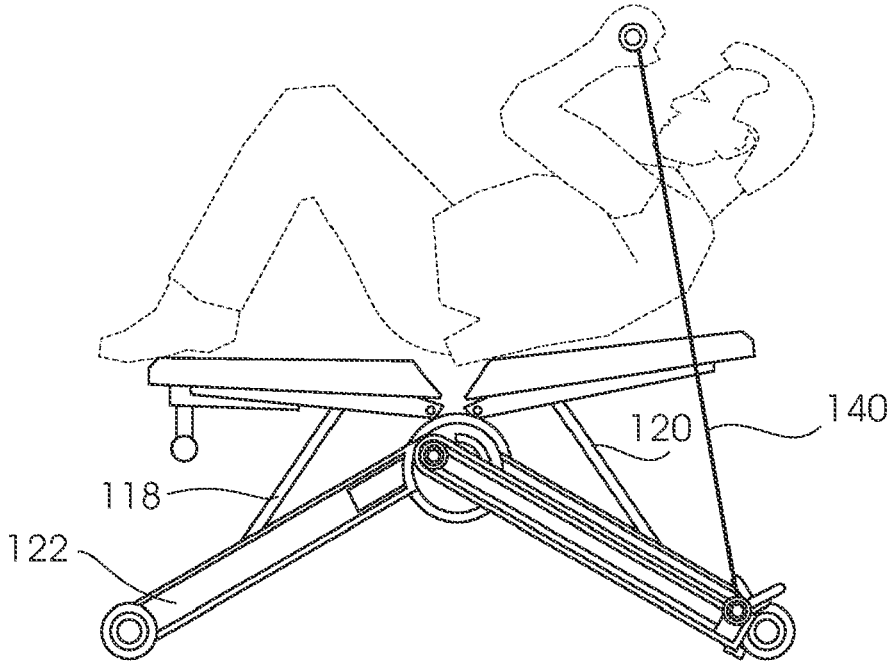
Figure 15:
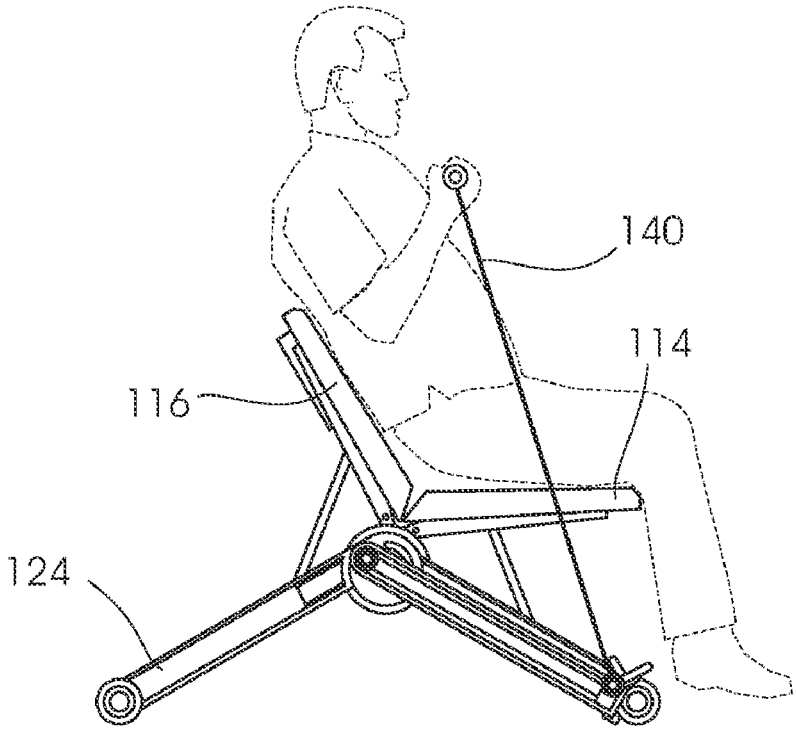

FIG. 14 shows a user exercising with the exercise machine in the configuration shown in FIG. 9. The bands 140 apply resistance over the shoulders of the user in a downwards direction. In FIG. 15 the seat and back rest have the positions shown in FIG. 11 but the resistance mechanism extends downwardly. This arrangement enables a user to do rowing-type exercises while seated.

Figure 16:
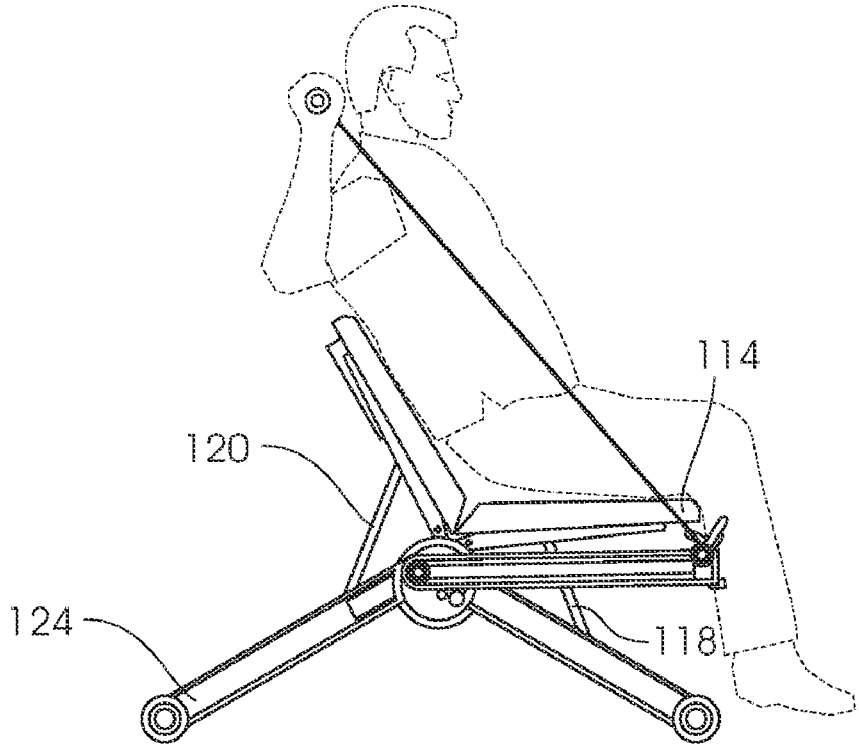

In the FIG. 16 mode the resistance mechanism has been elevated so that it extends more or less horizontally and the user is then able to do a rowing-type exercise while seated.

Figure 17:
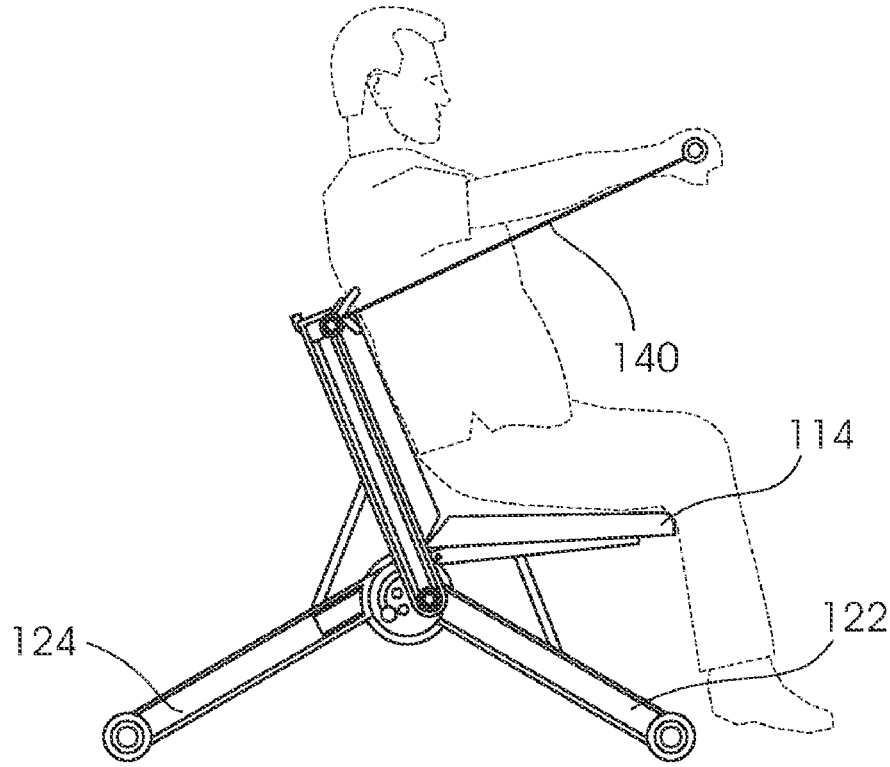
Figure 18:
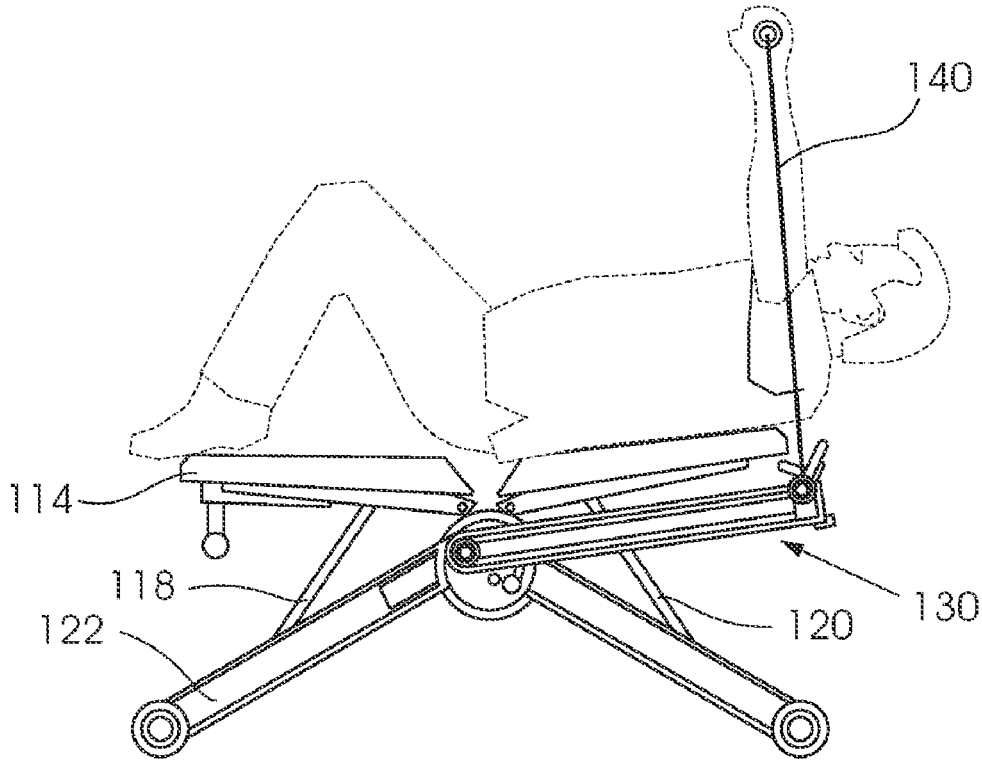

In FIG. 17 the resistance mechanism has been further elevated and extends upwardly so that the user can do a bench-press type exercise while seated. In FIG. 18 a similar exercise can be done but with the user in a reclined position.

The point from which the bands extend from the resistance mechanism to the user is not significantly displaced from the hub. The first and second legs 122 and 124 are splayed. The weight of the user imparts stability to the exercise machine. Any moment exerted by the user during exercising is thus significantly contained. By way of contrast in U.S. Pat. No. 5,718,659 the moment can be substantial, particularly if the resistance mechanism is more or less in line with the back rest. In the various modes of use of the exercise machine of the present invention handles at free ends of the bands 140 are at all times easily accessible. A user can therefore exercise effectively with a full range of movement in each mode of exercise. Similar observations also apply in respect of the machine 10.

The invention claimed is:

1. An exercise machine comprising:

a first support member pivotally movable around an axis extending through a hub, the first support member having a proximal end which is proximal the axis and a distal end opposed to the proximal end;

a second support member pivotally movable around the axis that extends through the hub, each of the first and second support members being independently pivotally movable from a downwardly inclined position through a horizontal position to an upwardly inclined position whereby the respective support member is usable as a seat or as a backrest for a user;

a ground-engaging support structure to which the first and second support members are mounted and which is adjustable to vary the inclination of each of the first and second support members relative to the ground;

first and second arms, on respective opposed sides of the first support member, which are fixed relative to the first support member so that when the first support member is pivotally moved about the axis the arms are also pivotally moved about the axis;

a resistance device mounted to the first and second arms;

first and second handles, respectively associated with the first and second arms, which are engaged with the resistance device and which are located, when the resistance device is not actuated, adjacent the distal end of the first support member and which are positioned to be gripped by a user who is seated on the first support member or on the second support member;

wherein the first and second support members are pivotally movable about the axis, and the ground-engaging support structure is adjustable to provide support for the first support member and for the second support member, at least in the following configurations:

(a) a first configuration in which a user can be seated on the first support member with the user's back supported by the second support member so that the user can exercise against the resistance device with a pull-type action, and (b) a second configuration in which a user can be seated on the second support member with the user's back, inclined or substantially horizontal, supported by the first support member so that the user can exercise against the resistance device with a bench-press-type action.

2. The exercise machine according to claim 1, wherein the ground-engaging support structure comprises first and second ground-engaging legs which are pivotally mounted to the hub and first and second struts positioned between the first and second support members and the first and second ground-engaging legs, respectively.

3. The exercise machine according to claim 1, wherein the resistance device includes a first resistance mechanism mounted to the first arm and a second resistance mechanism mounted to the second arm.

4. An exercise machine comprising:

a first support member pivotally movable about an axis extending through a hub;

a second support member pivotally movable around the axis that extends through the hub, each of the first and second support members being usable as a seat or as a backrest for a user;

a ground-engaging support structure to which the first and second support members are mounted and which is adjustable to vary the inclination of each of the first and second support members relative to the ground, wherein the ground-engaging support structure comprises first and second ground-engaging legs which are pivotally mounted to the hub and first and second struts positioned between the first and second support members and the first and second ground-engaging legs, respectively;

first and second arms, on respective opposed sides of the first support member, which are fixed relative to the first support member so that when the first support member is pivotally moved about the axis the arms are also pivotally moved about the axis;

a resistance device mounted to the first and second arms;

first and second handles, respectively associated with the first and second arms, which are engaged with the resistance device and which are positioned to be gripped by a user who is seated on the first support member or on the second support member; and a resistance element mounted to one of the first and second ground-engaging legs, the resistance element being anchored at one end to a point near or at the axis and passing over pulleys at an extremity of the one leg, wherein the first and second support members are pivotally movable about the axis, and the ground-engaging support structure is adjustable to provide support for the first support member and for the second support member, at least in the following configurations:

(a) a first configuration in which a user can be seated on the first support member with the user's back supported by the second support member so that the user can exercise against the resistance device with a pull-type action, and (b) a second configuration in which a user can be seated on the second support member with the user's back, inclined or substantially horizontal, supported by the first support member so that the user can exercise against the resistance device with a bench-press-type action.

* * * * *